United States Patent [19]

Wierszewski et al.

[11] Patent Number: 4,960,272

[45] Date of Patent: Oct. 2, 1990

[54] BOTTOM VACUUM CORRUGATION FEEDER STACK HEIGHT DETECTION SYSTEM CALIBRATION METHOD

[75] Inventors: Ronald R. Wierszewski, Henrietta; Richard F. Scarlata, Rochester; Thomas Acquaviva, Penfield; James F. Matysek, Fairport, all of N.Y.

[73] Assignee: Xerox Corporation, Stamford, Conn.

[21] Appl. No.: 344,635

[22] Filed: Apr. 27, 1989

[51] Int. Cl.[5] ..... B65H 5/22; G01C 25/00; G06M 7/00

[52] U.S. Cl. ..... 271/3.1; 271/105; 271/154; 73/1 J; 377/8

[58] Field of Search ..... 271/3.1, 97, 98, 99, 271/105, 154, 155, 31, 258, 265; 73/1 J; 377/8; 364/481, 486; 33/556, 558

[56] References Cited

U.S. PATENT DOCUMENTS 4,296,406 5/1981 Hamlin ..... 271/108
4,418,905 12/1983 Garavuso ..... 271/98
4,469,320 9/1984 Wenthe, Jr. ..... 271/105 X
4,489,645 5/1986 Tracy ..... 271/3.1

OTHER PUBLICATIONS

Michael S. Doery, "Adaptive Algorithm for RDH's (ABC Equation)", Xerox Disclosure Journal, vol. 9, No. 6, Nov./Dec., p. 393(1984).

*Primary Examiner*—Andres Kashnikow
*Assistant Examiner*—Kenneth DeRosa
*Attorney, Agent, or Firm*—William A. Henry, II

[57] ABSTRACT

A vacuum corrugation feeder stack height detection calibration system and method includes placing a single document in the document tray. Coupled to the stack height arm at the pivot point is a high resolution rotary encoder and dual beam sensor. The stack height arm is flipped up and then back down onto the document and pulses are counted. This difference in up and down pulses represents the "one sheet case." Software then stores this number in non-volatile memory and uses it to create a table of values for various document stack heights by adding constant values to the originally obtained "one sheet case" value.

3 Claims, 1 Drawing Sheet

Figure 1:
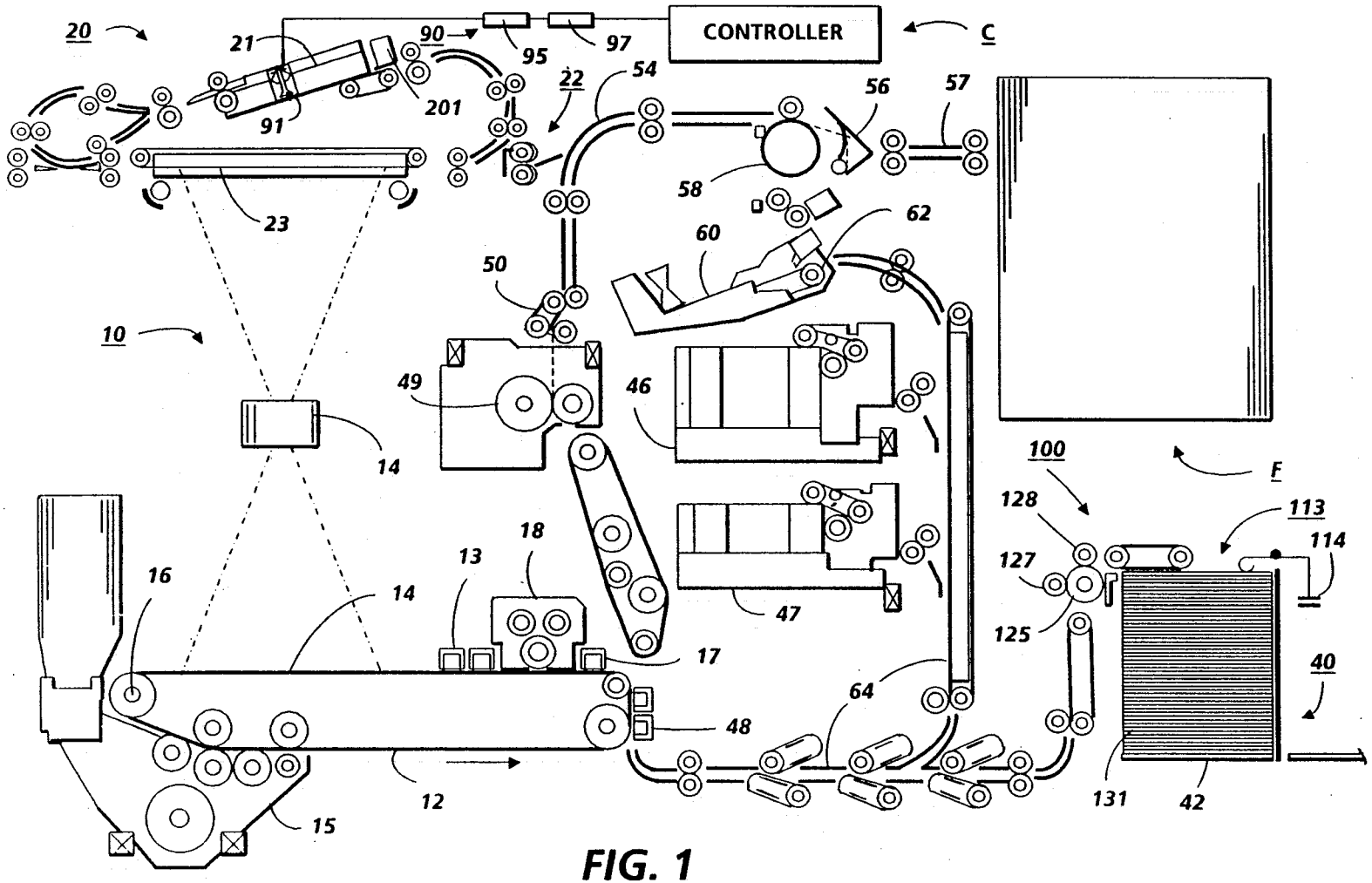

BOTTOM VACUUM CORRUGATION FEEDER STACK HEIGHT DETECTION SYSTEM CALIBRATION METHOD

Hereby cross-referenced, and incorporated by reference, is the copending application of the same assignee, U.S. Ser. No. 07/166,281 entitled "Improved Top Vacuum Corrugation Feeder" by Glenn M. Herbert et al., filed March 10, 1988 now U.S. Pat. No. 4,887,805.

This invention relates to an electrophotographic printing machine, and more particularly, concerns an improved method for calibrating the stack height detection system for a top vacuum corrugation feeder used in such a machine.

Present high speed xerographic copy reproduction machines and printers produce copies at a rate in excess of several thousand copies per hour, therefore, the need for a document handler to feed documents from a stack to a copy platen of the machine in a rapid dependable manner has been reorganized to enable full utilization of the machine's potential copy output. These document sheet feeders must operate flawlessly to virtually eliminate the risk of damaging the sheets and generate minimum machine shutdowns due to uncorrectable misfeeds or sheet multifeeds. It is in the initial separation of the individual sheets from the sheet stack where the greatest number of problems occur.

One of the recirculating document handlers (RDH) best known for high speed operation is the bottom vacuum corrugation feeder with a front air knife as disclosed in U.S. Pat. Nos. 4,296,406 and 4,418,905 which are incorporated herein to the extent necessary to practice the present invention. In these systems, a vacuum plenum with a plurality of friction belts arranged to run over the vacuum plenum is placed at the bottom of a stack of documents in a supply tray. At the front of the stack, an air knife is used to inject air into the stack to raise the stack so that the bottommost document can be separated from the remainder of the stack. In operation, air is injected by the air knife toward the stack to separate the bottom sheet, the vacuum pulls the separated sheet down and acquires it. Following acquisition, the belt transport drives the sheet forward off the stack of sheets.

In RDH's which use a bottom vacuum corrugation feeder (VCF), it is important to know how large of a stack of documents that a operator loads into the supply tray. This is because in order to feed the bottom sheet, the stack is levitated off the bottom sheet by the air knife and the amount of air required to accomplish this depends on the stack height. Too much air or too little air will result in misfeeds or multifeeds.

RDH stack height sensing with set-separator-arm motion position and look-up is shown in U.S. Pat. No. 4,489,645. An adaptive algorithm for other RDH variations is disclosed in the Xerox Disclosure Journal, Vol. 9, No. 6, Nov/Dec, 1984, p. 393. The heretofore mentioned references are included herein by reference to the extend necessary to practice the present invention.

Due to the emphasis on reliability and the fact that present RDH's handle up to 250 sheets in the feeder, a need has been shown to more accurately detect stack height within ±5 sheets. However, the mechanical tolerances between the stack height detection hardware and the tray that the documents are loaded into are not predictable and from machine to machine the error that this variability introduces to stack height measurement greatly exceeds the amount that present systems can tolerate for the required resolution.

Accordingly, disclosed herein is a method for calibrating the stack height detection system in a recirculating vacuum corrugation feeder, comprising the steps of (a) placing a single document in the document tray; (b) flipping the stack height arm onto the document; (c) counting pulses generated by the stack height arm when it is pivoted up and then back down onto the document, (d) calculating the height of the document by subtracting the pulses down from the pulses up; (e) storing this number in non-volatile memory; (f) and using the calculation of step (d) to create a table of values for various document stack heights by adding constant values to the originally obtained "one sheet case" value.

For a better understanding of the invention as well as other objects and further features thereof, reference is made to the following drawing and description.

FIG. 1 is a schematic elevational view of an electrophotographic printing machine incorporating the features of the present invention therein.

While the present invention will be described hereinafter in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is had to the drawing. In the drawing, like reference numerals have been used throughout to designate identical elements. FIG. 1 schematically depicts the various components of an illustrative electrophotographic printing machine incorporating the bottom feed vacuum corrugation feeder method and apparatus of the present invention therein. It will become evident from the following discussion that the sheet feeding system disclosed herein is equally well suited for use in a wide variety of devices and is not necessarily limited to its application to the particular embodiment shown herein. For example, the apparatus of the present invention may be readily employed in non-xerographic environments and substrate transportation in general.

Inasmuch as the art of electrophotographic printing is well known, the various processing stations employed in the FIG. 1 printing machine will be shown hereinafter schematically and the operation described briefly with reference thereto.

The exemplary copier 10 of FIG. 1 will now be briefly described. The copier 10 conventionally includes a xerograhic photoreceptor belt 12 and the xerographic stations acting thereon for respectively corona charging 13, image exposing 14, image developing 15, belt driving 16, precleaning discharge 17 and toner cleaning 18. Documents on the platen 23 may be imaged onto the photoreceptor 12 through a variable reduction ratio optical imaging system to fit the document images to the selected size of copy sheets.

The control of all machine functions, including all sheet feeding, is, conventionally, by the machine controller "C". The controller "C" is preferably a known programmable microprocessor, exemplified by the microprocessor disclosed in U.S. Pat. No. 4,166,558. The controller "C" conventionally controls all of the machine steps and functions described herein, and others, including the operation of the document feeder 20, all the document and copy sheet deflectors or gates, the sheet feeder drives, the finisher "F", etc.. The copier controller also conventionally provides for storage and comparison of the counts of the copy sheets, the number of documents recirculated in a document set, the desired number of copy sets and other selections and controls by the operator through the console or other panel of switches connected to the controller, etc.. The controller is also programmed for time delays, jam correction control, etc.. Conventional path sensors or switches may be utilized to help keep tract of the position of the documents and the copy sheets and the moving components of the apparatus by connection to the controller. In addition, the controller variably regulates the various positions of the gates depending upon which mode of operation is selected.

The copier 10 is adapted to provide either duplex or simplex precollated copy sets from either duplex or simplex original documents presented by the recirculating document handler (RDH) 20. Two separate copy sheet trays 46 and 47 and a multi-ream feeder apparatus 100 are provided for feeding clean copy sheets from either one selectably. They may be referred to as the main tray 46, auxiliary tray 47 and high capacity feeder 100.

The copy sheets are fed from the selected one of the trays 46, 47 or 100 to the transfer station 48 for the conventional transfer of the xerographic toner image of document images from the photoreceptor 12 to the first side of a copy sheet. The copy sheets are then fed by a vacuum transport to a roll fuser 49 for the fusing of that toner image thereon. From the fuser, the copy sheets are fed through a sheet decurler 50. The copy sheets then turn a 90° corner path 54 in the sheet path which inverts the copy sheets into a last-printed face-up orientation before reaching a pivotal decision gate 56. The image side which has just been transferred and fused is face-up at this point. If this gate 56 is down it passes the sheets directly on without inversion into the output path 57 of the copier to the finishing module "F". If gate 56 is up it deflects the sheets into a duplex inverting transport 58. The inverting transport (roller) 58 inverts and then stacks copy sheets to be duplexed in a duplex buffer tray 60.

The duplex tray 60 provides intermediate or buffer storage for those copy sheets which have been printed on one side and on which it is desired to subsequently print an image or images on the opposite side thereof, i.e. copy sheets in the process of being duplexed. Due to the sheet inverting by the roller 58, these buffer set copy sheets are stacked into the duplex tray 60 face-down. They are stacked in this duplex tray 60 on top of one another in the order in which they were copied.

For the completion of duplex copying, the previously simplexed copy sheets in the tray 60 are fed seriatim by its bottom feeder 62 back to the transfer station 48 for the imaging of their second or opposite side page image. This is through basically the same copy sheet transport path (paper path) 64 as is provided for the clean (bland) sheets from the trays 46, 47 or 100. It may be seen that this copy sheet feed path 64 between the duplex tray 60 and the transfer station 48 has an inherent inversion which inverts the copy sheets once. However, due to the inverting transport 58 having previously stacked these buffer sheets printed face-down in the duplex tray 60, they are represented to the photoreceptor 12 at the transfer station 48 in the proper orientation, i.e. with their blank or opposite sides facing the photoreceptor 12 to receive the second side image. This is referred to as the "second pass" for the buffer set copies being duplexed. The now fully duplexed copy sheets are then fed out again through the fuser 49 and fed out into the output path 57.

The output path 57 here transports the printed copy sheets directly, one at a time, into the connecting, online, modular, finishing station module "F". There the completed precollated copy sets may be finished by stapling, stitching, gluing, binding, and/or offset stacking. Suitable details are disclosed in the cited art, or other art, or in the applications cross-referenced hereinabove.

It is believed that the foregoing description is sufficient to illustrate the general operation of an electrostatographic machine.

Referring now to a particular aspect of the present invention, The copier of FIG. 1 has a means and method 90 for calibrating the stack height detection system of the RDH and includes an arm 91 that is controlled by conventional controller "C" and which pivots to the top of a stack of documents at the start of a job. Coupled to this arm at the pivot point is a conventional high resolution rotary encoder 95 and dual beam sensor 97. When the arm is pivoted up and then back down onto the stack the number of encoder pulses is counted. The difference between the pulses down is subtracted from the pulses up, and thus the stack height is measured and thereby gives the ±5 sheet resolution desired.

Generally, in a recirculating document handler 20 which in this instance is a vacuum corrugation feeder, a plurality of feed belts are supported for movement on feed belt rolls. Spaced within the run of the belts, there is provided a vacuum plenum having openings therein adapted for cooperation with perforations in the belts to provide a vacuum for pulling the bottom document in the document stack onto the belts. The plenum is provided with raised portion beneath the center run so that upon capture of the bottom document in the stack against the belts, a center corrugation will be produced in the bottom sheet. Also, the belts are below the surrounding support surfaces. Thus, the document is corrugated. The flat surfaces of the vacuum belts on each side of the raised center belt generates a region of maximum stress in the document which varies with the document beam strength. In the unlikely event that more than one document is pulled down into contact with the feed belts, the beam strength of the second document resists the corrugation action, thus gaps are opened between sheets one and two which extend to their lead edges. The gaps and channels reduce the vacuum levels between sheets one and two due to porosity in sheet one and provide for entry of the separating air flow from the air knife 201. The air knife 201 comprised of a pressurized air plenum having a plurality of air jet openings is provided to inject air into the pocket formed between the document pulled down against the feed belt and the documents thereabove to provide an air cushion or bearing between the stack and the bottom document to minimize the force necessary for removing the bottom document from the stack. It can be understood that if two documents are pulled down toward the belts, since the top sheet would not be corrugated, the air knife would inject air into the space between the two documents and force the second document off from the raised belt back toward the document stack.

The RDH is also provided with a sheet separator finger and stack height sensor 91 to separate the documents to be fed from those documents returned to the document handler. Upon removal of the last document from beneath sheet separator arm 91, the arm 91 drops through a slot provided in the document supply tray. Suitable sensors are provided to sense that the last document in the set has been removed from the tray and the finger is then rotated in a clockwise direction to again come to rest on the top of the documents in the stack prior to subsequent recirculation of the document set. In order to insure that the mechanical tolerances between stack height detection system 90 and the document support tray are compensated for, a method for calibrating the stack height detection system is included. In use of this calibration method, a single document is placed in the document tray and the stack height arm 91 is flipped onto the document and pulses are counted as earlier described. This difference in pulses represents the "one sheet case." Essentially, the mechanical tolerances become unimportant because this procedure enables one to determine an accurate and repeatable location for the first sheet in the stack. The controller then stores this number in non-volatile memory and uses it to create a table of values for various document stack heights by adding constant values to the originally obtained "one sheet case" value. Each of the added values represent the effect of additional documents. For example, 100 documents in the tray will be the "one sheet case" value+20 pulses.

It should now be understood that a solution to the machine-to-machine hardware variability between the RDH stack height and the set separator travel distance in a machine in which calibration of a table of values is obtained by noting the set separator arm motion for a single document. An encoder is used on the set separator arm with automatic data transfer rather than an optical sensor.

The calibration method is used at machine build, install and whenever there is any alteration in the stack height detection system hardware of document support ray. It should be understood that this separation finger calibration method customizes the separation finger positions for the particular machine and location.

What is claimed is:

1. A method for calibrating a stack height detection system that includes a pivoting stack height arm with a rotary encoder and a sensor connected thereto in a document feeder having a document support tray, comprising the steps of: (a) pivoting the stack height arm to a first position; (b) generating a series of pulses from the rotary encoder as the stack height arm is pivoted; (c) counting the number of pulses generated by the encoder as step (b) is accomplished; (d) placing a single document into the document tray; (e) pivoting the stack height arm into a second position and contact with the document; (f) generating a series of pulses from the rotary encoder as the stack height arm is pivoted into said second position; (g) counting the number of pulses generated by the encoder as the stack height arm is pivoted into said second position; (h) calculating the height of the document by subtracting the number of pulses generated by the encoder in step (f) from the number of pulses generated by the encoder in step (b) in order to obtain a one document value; (i) storing this value in non-volatile memory; and (j) using the value from step (h) to create a table of values for various document stack heights by adding constant values to the originally obtained value of step (h).

2. A method for calibrating a stack height detection system that includes a pivoting stack height arm with a high resolution rotary encodes and a dual beam sensor connected thereto in a recirculating vacuum corrugation feeder having a document support tray, comprising the steps of: (a) pivoting the stack height arm up with respect to the document tray; (b) generating a series of pulses from the rotary encoder as the stack height arm is pivoted; (c) counting the number of pulses generated by the encoder as step (b) is accomplished; (d) placing a single document into the document tray; (e) pivoting the stack height arm down onto the document; (f) generating a series of pulses from the rotary encoder as the stack height arm is pivoted down onto the document; (g) counting the number of pulses generated by the encoder as the stack height arm is pivoted onto the document; (h) calculating the height of the document by subtracting the number of pulses generated by the encoder in step (f) from the number of pulses generated by the encoder in step (b) in order to obtain a one document value; (i) storing this value in non-volatile memory; and (j) using the value from step (h) to create a table of values for various document stack heights by adding constant values to the originally obtained value of step (h).

3. A method for calibrating a stack height detection system that includes a pivoting stack height arm with a rotary encoder and a sensor connected thereto in a document feeder having a document support tray, comprising the steps of: (a) pivoting the stack height arm to a position above and removed from the document tray; (b) generating a series of pulses from the rotary encoder as the stack height arm is pivoted; (c) counting the number of pulses generated by the encoder as step (b) is accomplished; (d) placing a single document into the document tray; (e) pivoting the stack height arm into contact with the document; (f) generating a series of pulses from the rotary encoder as the stack height arm is pivoted onto the document; (g) counting the number of pulses generated by the encoder as the stack height arm is pivoted onto the document; (h) calculating the height of the document by subtracting the number of pulses generated by the encoder in step (f) from the number of pulses generated by the encoder in step (b) in order to obtain a one document value; (i) storing this value in non-volatile memory; and (j) using the value from step (h) to create a table of values for various document stack heights by adding constant values to the originally obtained value of step (h).

* * * * *